United States Patent [19]

Uchida

[11] Patent Number: 4,715,129

[45] Date of Patent: Dec. 29, 1987

[54] SHELF STRUCTURE FOR DRYING SACKED MATTER

[75] Inventor: Shiichiro Uchida, Fujisawa, Japan

[73] Assignee: Shonetsugaku Kenkyusho Co., Ltd., Tokyo, Japan

[21] Appl. No.: 824,573

[22] Filed: Jan. 23, 1986

[30] Foreign Application Priority Data

Jun. 24, 1985 [JP] Japan ..... 60-95468[U]

[51] Int. Cl.[4] ..... F26B 9/00

[52] U.S. Cl. ..... 34/195; 34/224; 34/232; 34/237

[58] Field of Search ..... 34/192, 195, 197, 224, 34/225, 232, 233, 237, 238, 239

[56] References Cited

U.S. PATENT DOCUMENTS

| | | | |
|---|---|---|---|
| 1,101,995 | 6/1914 | Calandra | 34/192 |
| 1,282,771 | 10/1918 | Dinesen | 34/237 |
| 2,382,084 | 8/1945 | Mathews | 34/196 |
| 2,456,481 | 12/1948 | Ballantyne et al. | 34/238 |
| 3,115,019 | 12/1963 | Rutishauser | 34/195 |

FOREIGN PATENT DOCUMENTS

| | | | |
|---|---|---|---|
| 100064 | 6/1925 | Fed. Rep. of Germany | 34/195 |
| 357424 | 3/1938 | Italy | 34/196 |

*Primary Examiner*—Albert J. Makay
*Assistant Examiner*—David W. Westphal
*Attorney, Agent, or Firm*—Oblon, Fisher, Spivak, McClelland, & Maier

[57] ABSTRACT

A shelf structure for drying sacked matter is disclosed which is capable of uniformly and effectively drying particulate matter while leaving it charged in an air-permeable sack. The shelf structure comprises a hollow support and hollow shelf boards communicated with the hollow support and each having at least one carrier section for supporting sacked matter thereon. The shelf structure is airtightly constructed except the carrier section and vent ports to permit drying air to be forcedly introduced through the carrier section in the structure and discharged from the vent ports.

3 Claims, 14 Drawing Figures

SHELF STRUCTURE FOR DRYING SACKED MATTER

BACKGROUND OF THE INVENTION

1. Field of the Invention

This invention relates to a drying shelf structure which is adapted to be arranged in a drying chamber to effectively dry matter, and more particularly to a shelf structure for drying sacked matter which is used for drying particulate matter charged in an air-permeable sack.

2. Description of the Prior Art

Conventionally, various kinds of drying techniques such as, for example, drying utilizing hot air due to the combustion of petroleum, drying air dehumidified by means of a refrigerator and the like have been used for drying agricultural and marine products stored in various sizes of drying chambers. In order to effectively carry out the drying, the conventional drying techniques each require the above-described hot air or dehumidified air (hereinafter referred to as "drying air") to be constantly flowed in a drying chamber and uniformly contacted with the surface of matter to be dried.

In order to meet such requirements, the conventional drying techniques employ a system wherein a drying chamber is partitioned by means of a plurality of horizontal wire mesh shelves vertically arranged at suitable intervals, on which matter to be dried is put, or the matter is suspended from a ceiling of the drying chamber at suitable intervals, so that it may be contacted with the drying air as uniformly as possible.

Also, the conventional drying techniques fail to effectively dry sacked matter or matter charge in an air-permeable sack. The term "matter to be dried" used herein indicates, for example, various kinds of grains, plant seeds and the like. Also, the term "air-permeable sack" used herein indicates a sack formed of a chemical fiber woven fabric or non-woven fabric, a natural fiber woven fabric, various kinds of net materials, or the like so as to exhibit air-permeability.

More particularly, the conventional techniques permit drying air to be supplied to the surroundings of sacked matter stored in a drying chamber but fail to cause it to enter the interior of the sacked matter even when a sack is air permeable, so that it may not be uniformly dried. This is remarkable particularly when sacked matter is stackedly placed. Accordingly, the drying of sacked matter has been obliged to be carried out by taking out the matter from a sack and spreading it or charging it in a rotary drum to dry it. The so-dried matter is recharged in the sack.

OBJECTS OF THE INVENTION

The present invention has been made in view of the foregoing disadvantage of the prior art.

Accordingly, it is an object of the present invention to provide a drying shelf structure of specific construction which is capable of effectively drying particulate matter while leaving it charged in a sack.

It is another object of the present invention to provide a pallet-like drying shelf structure of specific construction which is capable of effectively drying particulate matter while leaving it charged in a sack.

It is a further object of the present invention to provide a parllet-like drying shelf structure which is capable of permitting the access to a drying chamber and other operations to be facilitated by means of a fork lift truck and being arranged in a stacked manner while leaving sacked matter placed thereon.

SUMMARY OF THE INVENTION

In accordance with the present invention, there is provided a shelf structure of drying sacked matter comprising a hollow support having a hollow internal portion defined therein; and at least one hollow shelf board having a hollow internal portion defined therein and mounted on the hollow support so as to be communicated therewith; the hollow shelf board including at least one carrier section for placing sacked particulate matter thereon provided with vent holes through which the carrier section is communicated with the hollow internal portions; the hollow support having a vent port communicated with a drying unit.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein:

FIG. 8(*b*) is a plan view of the pallet-like shelf structure shown in FIG. 8(*a*);

FIG. 8(*c*) is a side elevation view of the pallet-like shelf structure shown in FIG. 8(*a*);

DETAILED DESCRIPTION OF THE PREFERRED EMBODIMENTS

Figure 1:
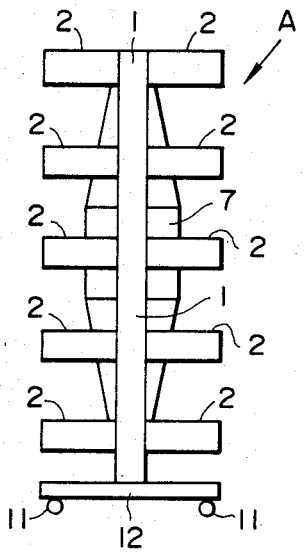
FIG. 1 is a front elevation view showing a first embodiment of a shelf structure for drying sacked matter according to the present invention.
Figure 2:
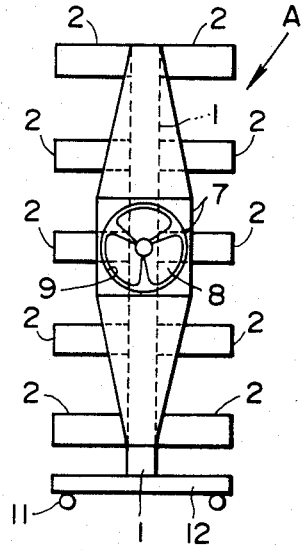
FIG. 2 is a rear view of the shelf structure shown in FIG. 1.

Now, a shelf structure for drying sacked matter according to the present invention will be described hereinafter with reference to the accompanying drawings.

FIGS. 1 to 6 illustrate a first embodiment of a drying shelf structure according to the present invention, wherein reference character A designates a drying shelf structure, which comprises a stand 12 having casters 11 mounted on a lower portion thereof, a hollow support 1 of a flat box-like shape vertically fixedly mounted on the stand 12, and a plurality of hollow shelf boards 2 of a flat box-like shape mounted on both sides of the hollow support 1 in a manner to be superposed on one another at suitable intervals. The hollow shelf boards 2 each are connected to the hollow support 1 to permit a hollow internal portion 5 (see FIG. 5) of the hollow shelf board 2 to be communicated with a hollow internal portion 4 of the hollow support 1.

Figure 3:
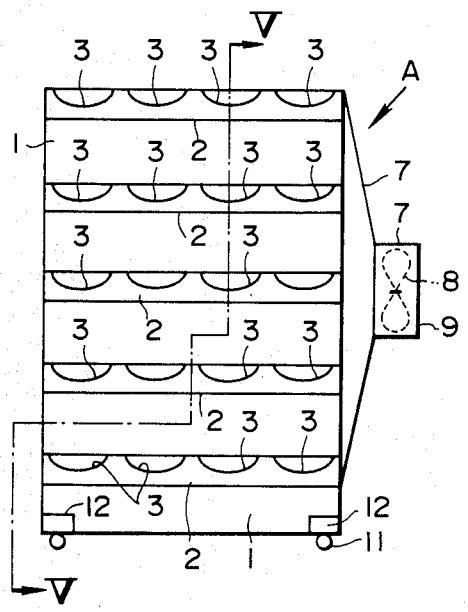
FIG. 3 is a side elevation view of the shelf structure shown in FIG. 1.
Figure 4:
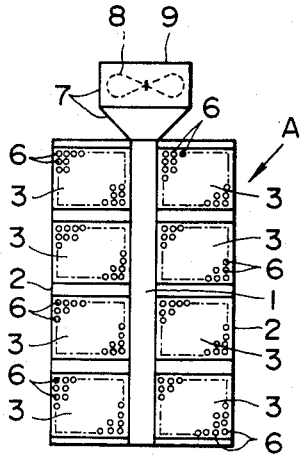
FIG. 4 is a plan view of the shelf structure shown in FIG. 1.

The hollow shelf boards 2 each are provided on an upper plate thereof with at least one carrier section 3 for placing sacked particulate matter 10 thereon. In this embodiment, a plurality of the carrier sections 3 are arranged as shown in FIG. 3. Also, in this embodiment, the upper plate of the hollow shelf board 2 is formed with a plurality of through-holes 6 which serve as vent holes for communicating each of the carrier sections 3 therethrough with the hollow internal portion 5 of the hollow shelf board 2. Alternatively, this may be carried out using a punched plate or a wire mesh for each of the carrier sections of the shelf board 2. 1 is provided on a rear portion thereof with a fan chamber 7, which is integrally mounted on the hollow support 1 and has a fan 8 arranged in a central portion thereof. The overall shelf structure A is constructed in an airtight manner except an exhaust vent 9 of the fan chamber 7 and the vent construction of the hollow carrier sections 3 of the shelf board 2 or the through-holes 6.

Figure 5:
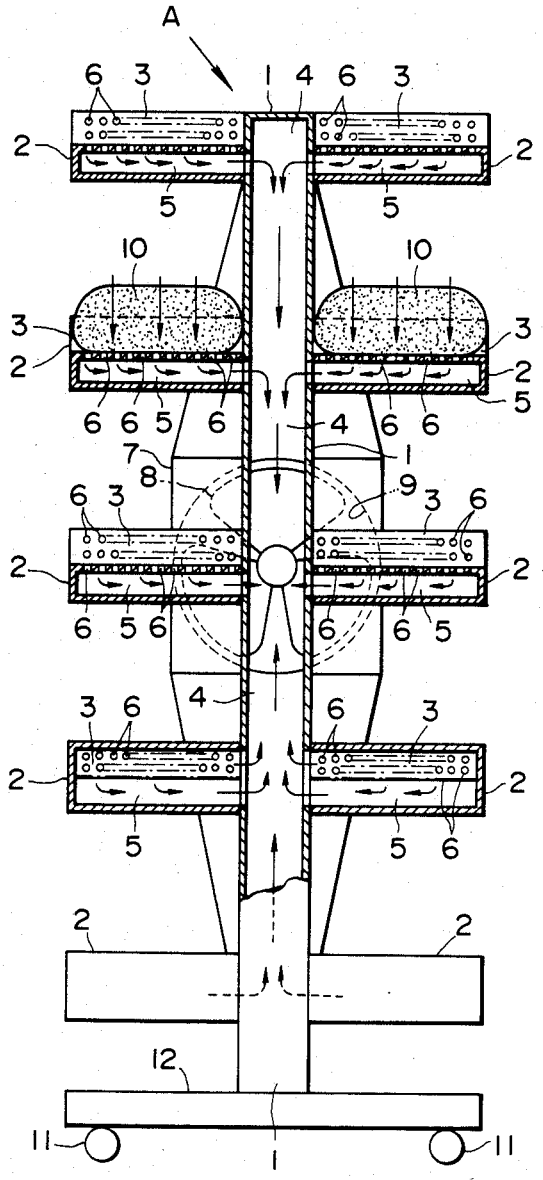
FIG. 5 is a partly enlarged sectional view taken along line V—V of FIG. 3.

In the illustrated embodiment, the carrier sections 3 of the hollow shelf board 2, as shown in FIG. 5, each are formed into a concave shape in conformity to the shape of a sack in which particulate matter is charged and the above-described through-holes 6 are provided at a concave bottom of the carrier section 3. Alternatively, it may be constructed in a manner such that a punched plate (not shown) is applied to the carrier section 3 formed into a flat plate-like shape. Thus, it will be noted that the carrier section 3 may be constructed in a desired manner so long as it is communicated with the hollow internal portion 5 of the hollow shelf board 2 and carries sacked material thereon.

Now, the manner of operation of the drying shelf structure A of the illustrated embodiment described above will be described hereinafter.

Figure 6:
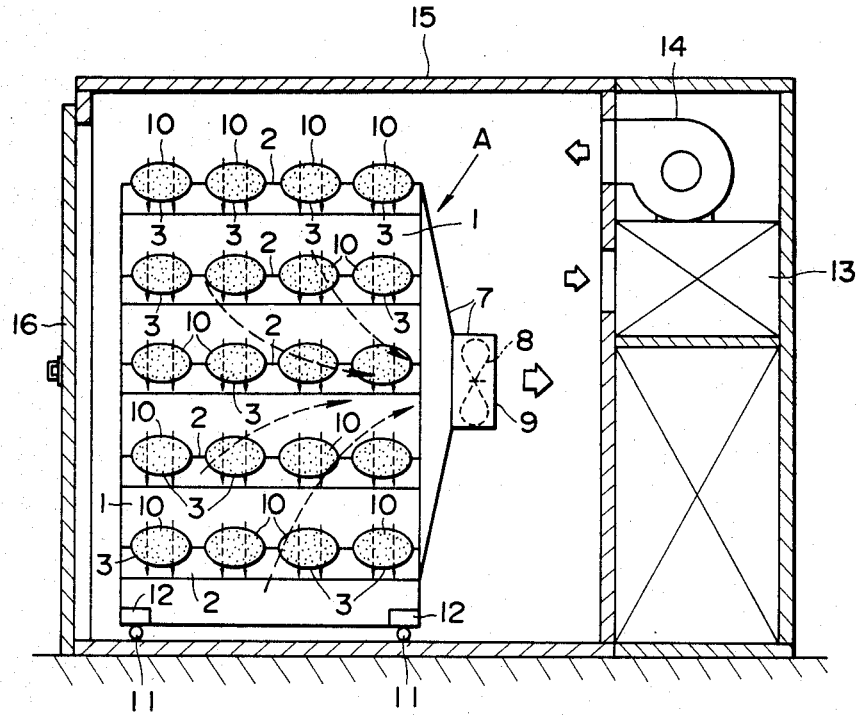
FIG. 6 is a schematic view showing the manner of carrying out the drying of sacked matter placed on the shelf structure of FIG. 1 arranged in a drying chamber.

At least one shelf structure A is used for drying sacked matter. Sacked particulate matter 10 (such as, for example, sacked seed) is placed on each of the carrier sections 3 of each hollow shelf board 2 of the shelf structure A. Then, the shelf structure A is moved through on the casters 11 into a suitable drying chamber 15 (see FIG. 6). In the illustrated embodiment, the drying chamber 15 used, as shown in FIG. 6, is constructed in a manner such that air sucked into the drying chamber 15 is dehumidified by means of a dehumidifier 13 of a refrigerator and heated by means of a heater (not shown) to prepare drying air or dehumidified hot air, and the so-formed drying air is circulated in the drying chamber 15 by means of a blower 14. Reference numeral 16 designates a door for a port opening.

Then, when the fan 8 of the shelf structure A is actuated, air in the hollow internal portion 4 and 5 of the hollow support 1 and the hollow shelf boards 2 is forcedly discharged from the exhaust vent 9, because the hollow internal portions are communicated with the fan chamber 7 and the shelf structure A is airtightly constructed. This casues a difference in pressure between the hollow internal portions 4, 5 and the drying chamber 15 to occur so that the hollow internal portions 4, 5 have negative pressure, resulting in drying air in the drying chamber being forcibly sucked through the vent construction comprising the through-holes 6 of each of the carrier sections 3 into the hollow internal portions 4 and 5.

Accordingly, when sacked particulate matter 10 is put on the carrier sections 3 of each of the hollow shelf boards 2, the drying air is introduced through the sacked particulate matter 10 into the hollow internal portions 4, 5. The sacked particulate matter 10 is thereby uniformly and effectively dried.

Figure 7:
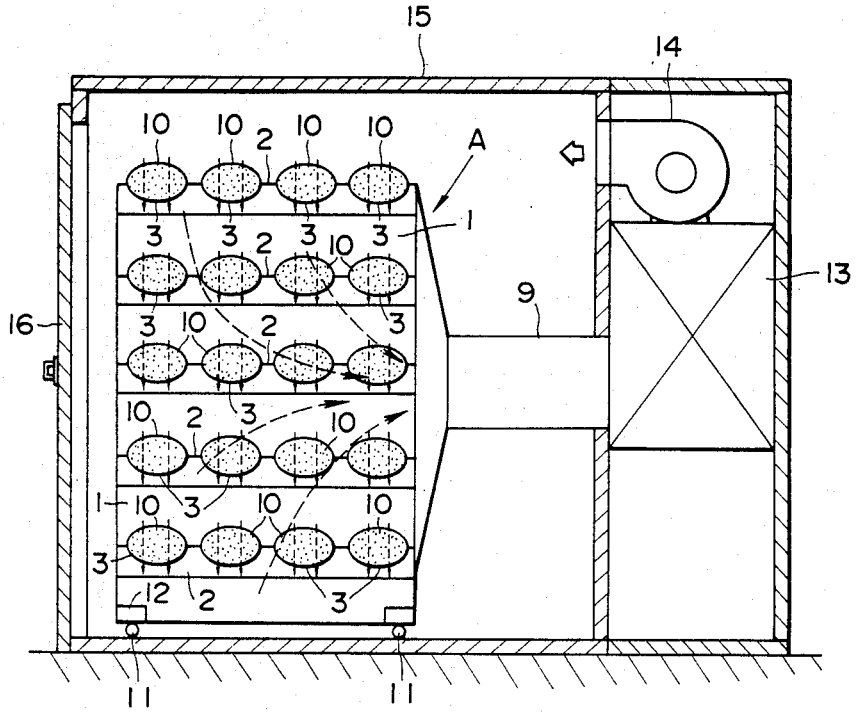
FIG. 7 is a schematic view showing a modification of the embodiment shown in FIG. 1.

FIG. 7 shows a modification of the embodiment described above, which is so constructed that an exhaust vent 9 provided on a rear surface of a hollow support is communicated directly with a dehumidifier of a refrigerator. Such construction allows the installation of any fan such as the fan 8 to be eliminated, so that the circulation of drying air in a drying chamber may be carried out by means of only a blower 14.

In the illustrated embodiment, as described above, the hollow support, the hollow shelf boards, and the fan chamber may be constructed in an airtight manner. This causes air in the hollow internal portions to be forcibly sucked to generate a pressure difference between the hollow internal portions and the drying chamber when the fan is actuated, to thereby outwardly exhaust air in the hollow internal portions. The so-generated pressure difference results in drying air in the drying chamber being substitutedly sucked via the through-holes 6 of the carrier sections 3 into the shelf structure A, so that particulate matter charged in an air-permeable sack which is placed on the carrier sections may be uniformly and effectively dried because drying air is introduced through the sack and particulate matter into the shelf structure.

Figure 8A:
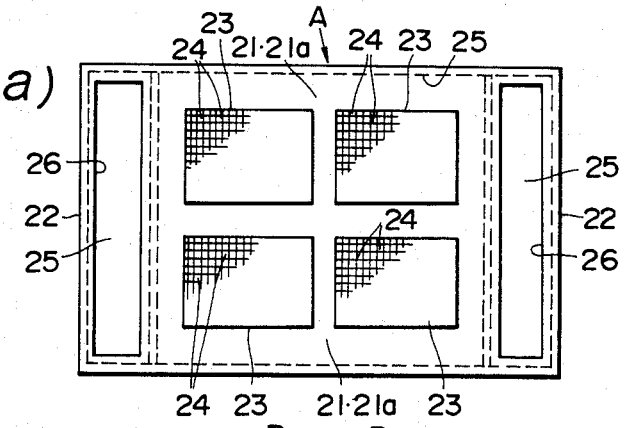
FIG. 8(*a*) is a vertical sectional front elevation view showing a second embodiment of a pallet-like shelf structure for drying sacked matter according to the present invention.
Figure 8B:
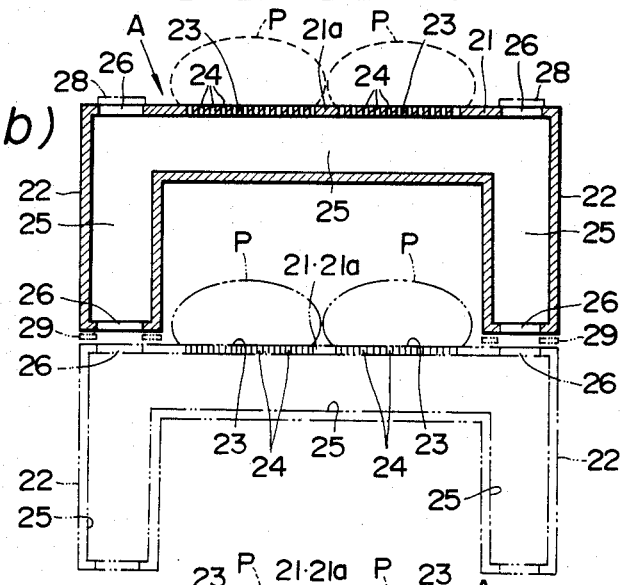
Figure 8C:
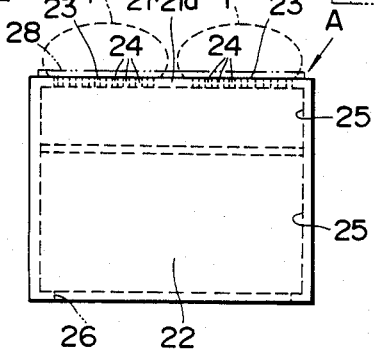
Figure 9:
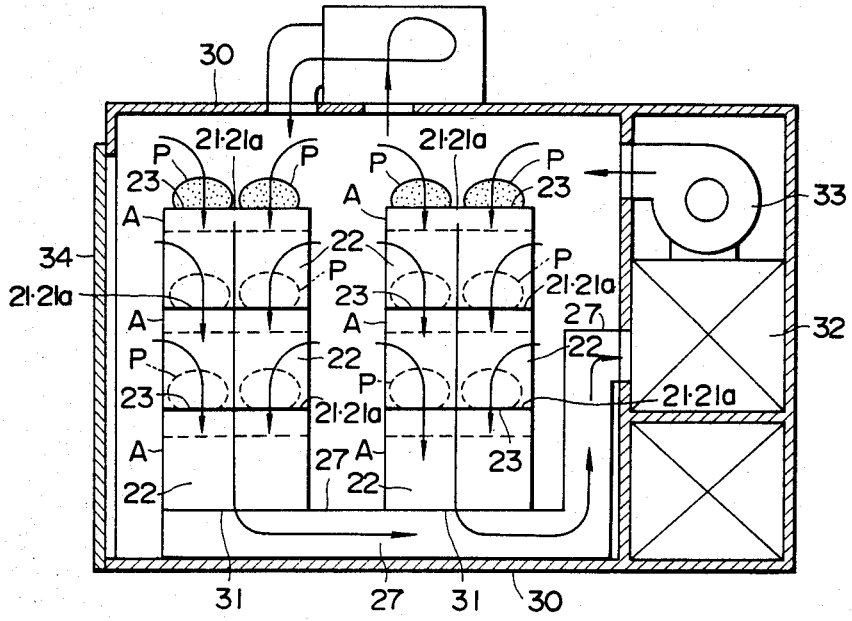
FIG. 9 is a schematic side elevation view showing a plurality of the pallet-like shelf structures of FIG. 8 superposed on one another.
Figure 10:
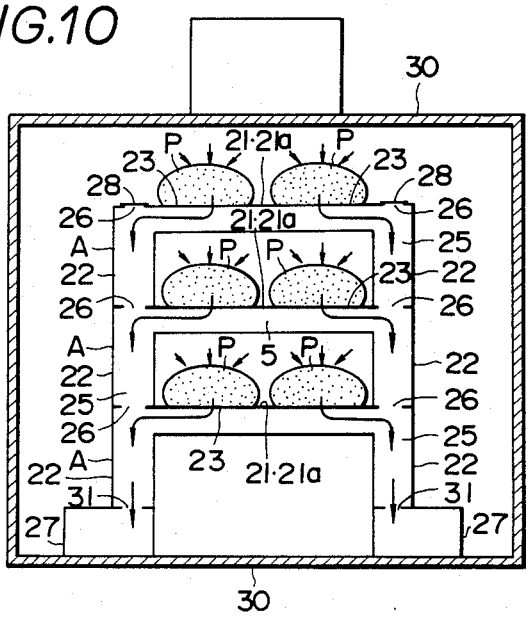
FIG. 10 is a schematic front elevation view of the stacked shelf structures shown in FIG. 9.

FIGS. 8 to 10 show a second embodiment of a shelf structure for drying sacked matter according to the present invention. In the second embodiment, a shelf structure is formed into a pallet-like shape or a table-like shape. The pallet-like shelf structure generally designated by reference character A comprises a hollow top board 21 and hollow legs 22 communicated with the hollow top board 21. The hollow top board 21 includes an upper wall 21*a* acting as carrier sections 23 for placing sacked matter P thereon. The carrier sections 23 each are formed with small through-holes or vent holes 24 to communicate the carrier sections 23 with an hollow internal portion 25 of the shelf structure A. The hollow legs 22 each are provided at upper and lower surfaces thereof with openings 26 serving as vent ports. The shelf structure is airtightly constructed except the carrier sections 23 and the openings 26. A plurality of the shelf structures A constructed as described above are stackedly arranged by superposing the hollow legs 22 on one another as shown in FIG. 8(*b*) in a manner to communicate the hollow legs 22 with one another through the vent ports openings 26. One of the uppermost and lowermost pallet-like shelf structures A is communicated through the openings 26 with a suitable suction duct 27 (see FIG. 9), and the free openings 26 each are closed with a suitable means such as a lid plate 28 (see FIG. 10). Reference numeral 29 designates an airtight packing.

In the pallet-like shelf structure A constructed as described above, sacked matter P is placed on each of the carrier section 23 to cover vent construction thereof or the through-holes 24.

The suction duct 27 may be communicated with either the uppermost pallet-like shelf structure, or the uppermost one as desired. In the illustrated embodiment, the stacking of the shelf structures A and the communication of the stacked structures A with the suction duct 27 may be carried out, for example, in a manner such that the lowermost structure A having sacked matter P placed on the carrier sections 23 is carried into a drying chamber 30 and put on a floor of the room by means of a fork lift truck of which a fork has been inserted under a lower plate of the hollow top board 21 in a manner to communicate the openings 26 of the hollow legs 22 with vent ports 31 of the suction duct 27, the remaining shelf structures A are stacked on the lowermost shelf structure in order, and then the free openings 26 of the uppermost shelf structure A are closed with the lid plates 28.

The drying chamber 30 may be constructed in a desired manner. For example, it, as shown in FIG. 9, may be so constructed that air therein is dehumidified by means of a dehumidifier 32 of a refrigerator and heated by a suitable heater (not shown) to prepare drying air or dehumidified hot air, and the drying air is then circulated in the drying chamber 30 using a blower 33. Reference numeral 34 indicates a door for a door opening. The pallet-like shelf structures A may be stackedly installed in the so-constructed drying chamber, as described above.

The manner of operation of the pallet-like shelf structure shown in FIGS. 8 to 10 will be described hereinafter.

When the blower 33 is actuated to suck air through the suction duct 27 into the dehumidifier 32, air in the hollow internal portion 25 is forcibly discharged therefrom to generate a pressure difference between the hollow internal portions 25 and the drying chamber 30 because the hollow legs 22 and the hollow top boards 21 of the shelf structures A are communicated with one another, and the structures A are airtightly constructed, so that the hollow internal portions 25 have negative pressure. This causes drying air in the drying chamber 30 to be forcibly sucked via the vent construction or through-holes 24 of the carrier sections 23 into the hollow internal portions 25.

Accordingly, when matter charged in an air-permeable sack is placed on each of the carrier sections 23, the drying air is introduced throughout the sack and matter into the internal portions to permit the drying air to uniformly contact with the matter, to thereby uniformly and effectively dry the whole matter.

In the second embodiment of the present invention, as described above, the top board 21 and the legs 22 are constructed in a hollow and airtight manner. Accordingly, the actuation of the blower causes air in the hollow internal portions 25 to be forcibly sucked to generate a pressure difference between the hollow internal portions 25 and the drying chamber 30, resulting in drying air in the drying chamber 30 being sucked through the through-holes 24 into the shelf structure. Thus, particulate matter charged in an air-permeable sack which is placed on the carrier sections 23 is uniformly and effectively dried because the drying air passes through the sack and particulate matter to uniformly contact with the matter.

Also, the pallet-like shelf structure of the second embodiment comprises the top board 21 and the legs 22 are connected together to have a hollow table-like or pallet-like shape. Thus, the embodiment is advantageous in that a plurality of such pallet-like shelf structures are used in a superposed manner. Also, such construction allows the shelf structure to be transported by means of a fork lift truck of which a fork has been inserted under the lower surface of the top board 21. Thus, it will be noted that the transportation of the shelf structure into the drying chamber 30, the superposition of the shelf structure on one another, the taking-out of the shelf structure from the drying chamber 30, and the like can be effectively accomplished using only a fork lift truck.

Figure 11:
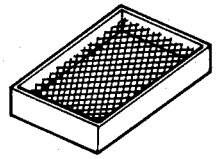
FIG. 11 is a schematic view showing a modification of a sack adapted to charge particulate matter therein.
Figure 12:
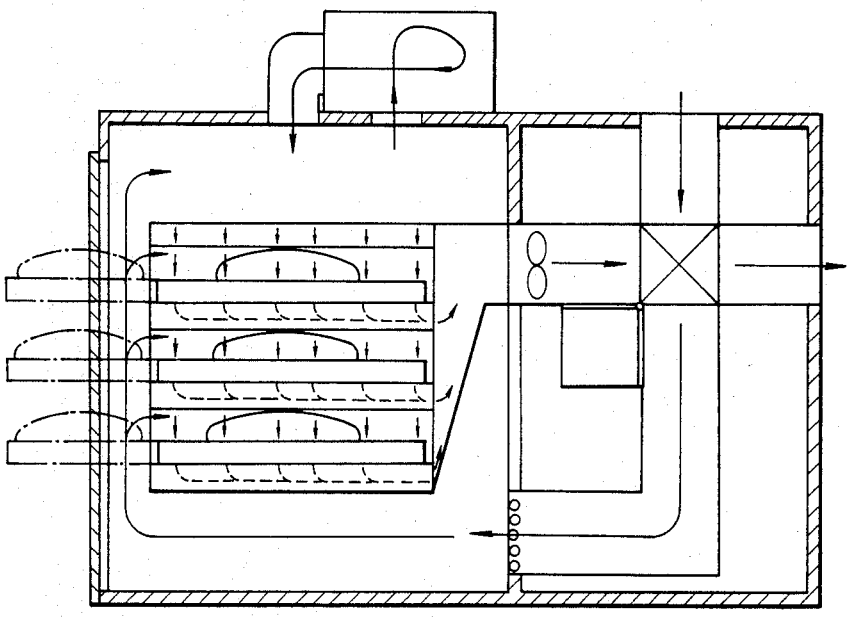
FIG. 12 is a schematic view showing a modification of a drying shelf structure according to the present invention.

The above-described embodiments each are directed to the drying of particulate matter charged in an air-permeable sack. However, the present invention is not limited to the drying of such sacked matter. For example, it may use an air-permeable container formed into a flat box-like shape as shown in FIG. 11. More particularly, the container comprises four side walls and an air-permeable botton wall formed of a wire mesh or the like. The container charged with particulate matter to be dried is then placed on the carrier section to uniformly contact drying air with the matter. Further, the hollow shelf on which sacked matter is to be placed may be constructed in a drawer-like manner as shown in FIG. 12.

While preferred embodiments of the invention have been described with a certain degree of particularity with reference to the drawings, obvious modifications and variations are possible in the light of the above teachings. It is therefore to be understood that within the scope of appended claims, the invention may be practiced otherwise than as specifically described.

What is claimed is:

1. A shelf structure for drying sacks of particulate matter, said shelf structure comprising a plurality of hollow pallet-shaped shelves, each one of said plurality of hollow pallet-shaped shelves comprising:

(a) a hollow top board having a hollow internal portion defined therein and a carrier section defined on the top thereof, said carrier section serving, in use, to support at least one sack of particulate matter, said carrier section having a plurality of through-holes therein providing communication between said hollow internal portion and the exterior of said hollow top board;

(b) a plurality of hollow legs extending downwardly from said hollow top board at horizontally spaced intervals, each one of said plurality of hollow legs having a hollow internal portion defined therein, each one of said hollow internal portions in said plurality of hollow legs being in communication with said hollow internal portion in said hollow top board, said plurality of hollow legs being sized, shaped, and positioned so that said plurality of hollow pallet-shaped shelves can be stacked vertically on top of each other to form said shelf structure; and (c) means for creating a pressure differential between said hollow internal portion and the exterior of said shelf structure, said means comprising:

(i) a first opening in the bottom of at least one of said plurality of hollow legs on each one of said plurality of said hollow pallet-shaped shelves and (ii) a second opening in said hollow top board on each one of said plurality of hollow pallet-shaped shelves sized, shaped, and positioned to communicate with said first opening in the next higher one of said plurality of hollow pallet-shaped shelves when said plurality of hollow pallet-shaped shelves are stacked to form said shelf structure.

2. A shelf structure as recited in claim 1 wherein said means further comprises a lid plate sized, shaped, and positioned to close said second opening in the uppermost one of said plurality of hollow pallet-shaped shelves when said plurality of hollow pallet-shaped shelves are stacked to form said shelf structure.

3. A shelf structure as recited in claim 1 wherein said means further comprise a blower.

* * * * *